US009230750B2

(12) United States Patent
Yamashita et al.

(10) Patent No.: US 9,230,750 B2
(45) Date of Patent: Jan. 5, 2016

(54) GAS CIRCUIT BREAKER

(75) Inventors: Toru Yamashita, Tokyo (JP); Daisuke Yoshida, Tokyo (JP); Hirokazu Otani, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/238,604

(22) PCT Filed: Oct. 19, 2011

(86) PCT No.: PCT/JP2011/074067

§ 371 (c)(1),
(2), (4) Date: Feb. 12, 2014

(87) PCT Pub. No.: WO2013/057808

PCT Pub. Date: Apr. 25, 2013

(65) Prior Publication Data

US 2014/0202991 A1 Jul. 24, 2014

(51) Int. Cl.

| | |
|---|---|
| ***H01H 11/00*** | (2006.01) |
| ***H01H 9/34*** | (2006.01) |
| ***H01H 33/98*** | (2006.01) |

(52) U.S. Cl.

CPC ..... *H01H 9/346* (2013.01); *H01H 33/98* (2013.01)

(58) Field of Classification Search

CPC ..... H01H 33/98; H01H 33/88; H01H 11/00; H01H 2033/6623; H01H 33/66207

USPC ..... 218/11, 42, 46, 63, 117

See application file for complete search history.

(56) References Cited

U.S. PATENT DOCUMENTS 5,902,978 A 5/1999 Zehnder et al.
6,163,001 A 12/2000 Zehnder et al.

(Continued)

FOREIGN PATENT DOCUMENTS

CN 1170948 A 1/1998
CN 1232279 A 10/1999

(Continued)

OTHER PUBLICATIONS

International Search Report (PCT/ISA/210) mailed on Jan. 17, 2012, by the Japanese Patent Office as the International Searching Authority for International Application No. PCT/JP2011/074067.

(Continued)

*Primary Examiner* — Truc Nguyen

(74) *Attorney, Agent, or Firm* — Buchanan Ingersoll & Rooney PC

(57) ABSTRACT

An outer peripheral wall surrounds a heating chamber that communicates with an arc chamber through an opening that separates fixed contacts from each other in a circumferential direction. The outer peripheral wall includes a heat-resistive cylindrical heat-flow receiving wall portion that is arranged at a position opposed to the opening in a radial direction, and a cylindrical wall portion that is connected to the heat-flow receiving wall portion in a direction of a center axis and also connected to a fixed-side energizing member at its one end on the opposite side to where the wall portion is connected to the heat-flow receiving wall portion, and is made of an insulating material. With this configuration, the outer peripheral wall surrounding the heating chamber can be protected from damage and heat deterioration due to the influence of hot gas.

7 Claims, 6 Drawing Sheets

(56) References Cited

U.S. PATENT DOCUMENTS

| | | | | |
|---|---|---|---|---|
| 2007/0262053 | A1* | 11/2007 | Yoshitomo | H01H 33/88 218/59 |
| 2008/0006609 | A1* | 1/2008 | Schoenemann | H01H 33/74 218/157 |
| 2010/0038343 | A1* | 2/2010 | Sato | H01H 33/666 218/139 |
| 2010/0243611 | A1* | 9/2010 | Takahashi | H01H 33/666 218/139 |
| 2013/0161288 | A1 | 6/2013 | Yamashita et al. | |
| 2014/0367360 | A1* | 12/2014 | Ono | C23C 22/68 218/61 |
| 2015/0027986 | A1* | 1/2015 | Siebens | H01H 11/00 218/93 |
| 2015/0102013 | A1* | 4/2015 | Yamazaki | H01H 33/66207 218/3 |

FOREIGN PATENT DOCUMENTS

| | | | |
|---|---|---|---|
| CN | 1232280 | A | 10/1999 |
| EP | 0800191 | A2 | 10/1997 |
| EP | 0951039 | A1 | 10/1999 |
| EP | 0951042 | A2 | 10/1999 |
| JP | 59-215624 | A | 12/1984 |
| JP | 60-091519 | A | 5/1985 |
| JP | 05-020234 | U | 3/1993 |
| JP | 07-288072 | A | 10/1995 |
| JP | 08-138506 | A | 5/1996 |
| JP | 10-031944 | A | 2/1998 |
| JP | 10-106408 | A | 4/1998 |
| JP | 11-329191 | A | 11/1999 |
| JP | 2000-067716 | A | 3/2000 |
| JP | 2010-282802 | A | 12/2010 |
| WO | WO 2012/049730 | A1 | 4/2012 |

OTHER PUBLICATIONS

Written Opinion (PCT/ISA/237) mailed on Jan. 17, 2012, by the Japanese Patent Office as the International Searching Authority for International Application No. PCT/JP2011/074067.

Office Action issued on Jul. 3, 2015, by the Chinese Patent Office in corresponding Chinese Patent Application No. 201180074209.7 and an English Translation of the Office Action. (9 pages).

* cited by examiner

GAS CIRCUIT BREAKER

FIELD

The present invention relates to a gas circuit breaker that is used to pass an operating current and break an overcurrent in a power plant, a substation, and the like.

BACKGROUND

As a conventional gas circuit breaker, there is a gas circuit breaker disclosed in Patent Literature 1, for example. As shown in FIG. 1 of Patent Literature 1, a fixed contact and a movable contact come into contact with each other in a power-on state of the gas circuit breaker, and the movable contact comes into contact with a slide guide and is in an energized state. A heating chamber is surrounded by a wall formed of an insulating material, the fixed contact, and a nozzle. A part of the heating chamber communicates with an arc chamber through a spray slit. At the time of current breaking, the movable contact moves downward in the drawing to generate arc between the fixed contact and the movable contact. Some of gas heated to a high temperature by the arc flows into the heating chamber through the spray slit and is also discharged to an outlet port through a pressure chamber, and some flows to the movable-contact side. Arc and hot gas generated by a series of the breaking operation damage energizing members such as the fixed contact and the movable contact, and damage insulating materials such as the nozzle and the wall.

Furthermore, in a case of a gas circuit breaker shown in FIG. 2 of Patent Literature 1, in addition to a first fixed contact, a second fixed contact is provided on the movable-contact side to make an energized state among the first fixed contact, the movable contact, and the second fixed contact. At the time of current breaking, the movable contact moves downward in the drawing to generate arc between the first fixed contact and the movable contact. Burnout rings that are electrically connected respectively to the first and second fixed contacts are provided between the first and second fixed contacts. As the movable contact moves downward in the drawing, arc moves between the burning rings. Hot gas flows substantially in the same manner as in the case of FIG. 1 of the Patent Literature. Also in this case, arc and hot gas generated by the breaking operation damage energizing members such as the first fixed contact, the second fixed contact, the burnout rings, and the movable contact, and damage an insulating material of a wall.

In the hot gas flow as described above, particularly, high-temperature and high-speed hot gas flowing into the heating chamber from the spray slit travels in a straight line in a radial direction and collides with the wall, and then disperses in the heating chamber.

CITATION LIST

Patent Literature

Patent Literature 1: Japanese Patent Application Laid-open No. H11-329191 (FIGS. 1 and 2)

SUMMARY

Technical Problem

As described above, in the case of the conventional gas circuit breakers, current breaking is repeatedly performed, so that constituent components of the gas circuit breakers are damaged. Particularly, high-temperature and high-speed hot gas flowing into the heating chamber from the spray slit collides with the wall, and the part where this hot gas has collided is severely damaged. Therefore, there is a problem that the deterioration of the insulating material of the wall makes it difficult to maintain the performance of the gas circuit breaker.

The present invention has been achieved to solve the above problems, and an object of the present invention is to provide a gas circuit breaker that is capable of protecting an outer peripheral wall surrounding a heating chamber from damage and heat deterioration due to the influence of hot gas.

Solution to Problem

In order to solve the aforementioned problems, a gas circuit breaker according to one aspect of the present invention is configured to includes: a fixed-side energizing member; a movable-side energizing member that is arranged to be opposed to the fixed-side energizing member in an opening-and-closing axis direction; a first fixed contact that is connected to the fixed-side energizing member; a second fixed contact that is connected to the movable-side energizing member, and is arranged to be opposed to the first fixed contact in the opening-and-closing axis direction; a movable contact that is capable of switching between a power-on position and a breaking position by being driven back and forth in the opening-and-closing axis direction, bridges between the first fixed contact and the second fixed contact at the power-on position, and is brought into non-contact with the first and second fixed contacts at the breaking position to form an arc chamber between the first and second fixed contacts; and a cylindrical outer peripheral wall that is connected to the fixed-side energizing member and the movable-side energizing member, and that surrounds a heating chamber that communicates with the arc chamber through an opening that separates the first and second fixed contacts from each other in a circumferential direction, wherein the outer peripheral wall includes a heat-resistive cylindrical first wall portion that is arranged at a position opposed to the opening in a radial direction, and a cylindrical second wall portion that is connected to the first wall portion and also connected to at least one of the fixed-side energizing member and the movable-side energizing member, and is made of an insulating material.

Advantageous Effects of Invention

According to the present invention, it is possible to obtain a gas circuit breaker that is capable of protecting an outer peripheral wall surrounding a heating chamber from damage and heat deterioration due to the influence of hot gas.

DESCRIPTION OF EMBODIMENTS

Exemplary embodiments of a gas circuit breaker according to the present invention will be explained below in detail with reference to the accompanying drawings. The present invention is not limited to the embodiments.

First Embodiment

Figure 1:
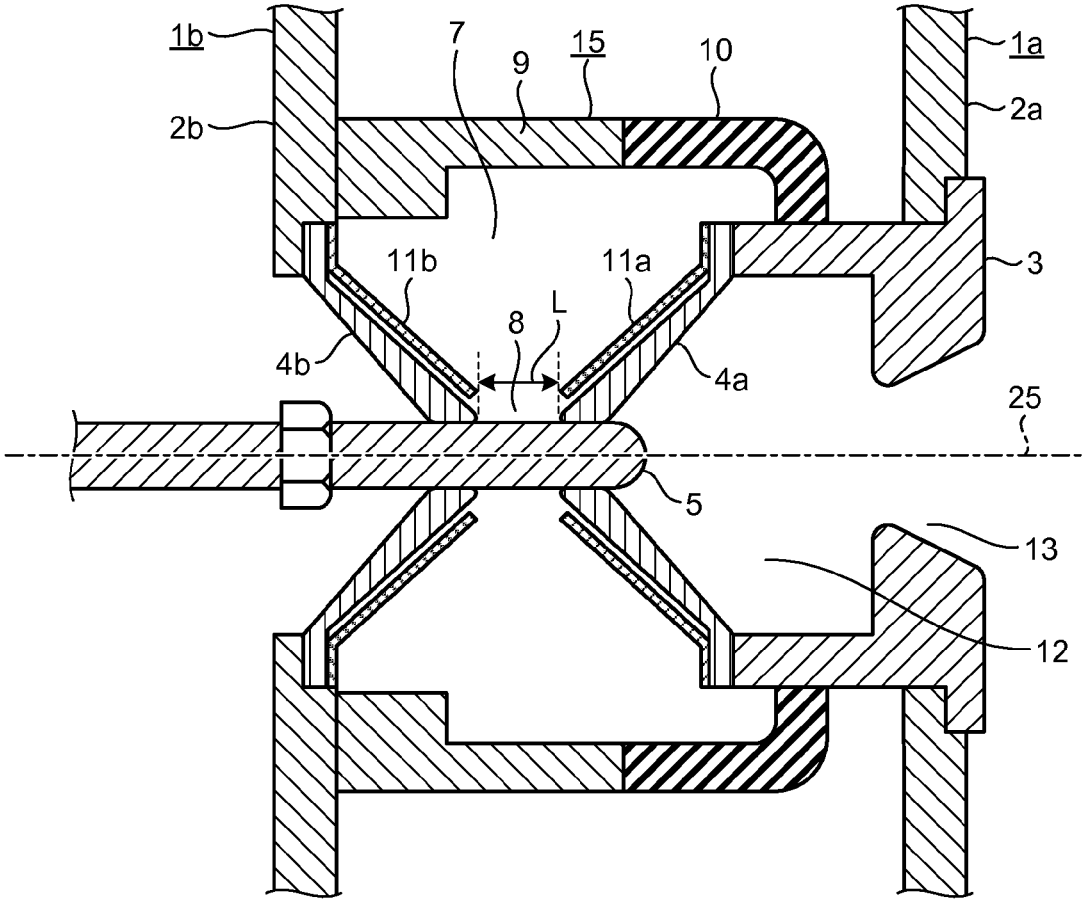
FIG. 1 is a cross-sectional view of a configuration of relevant parts of an arc-quenching chamber of a gas circuit breaker according to a first embodiment, and depicts a power-on state.
Figure 2:
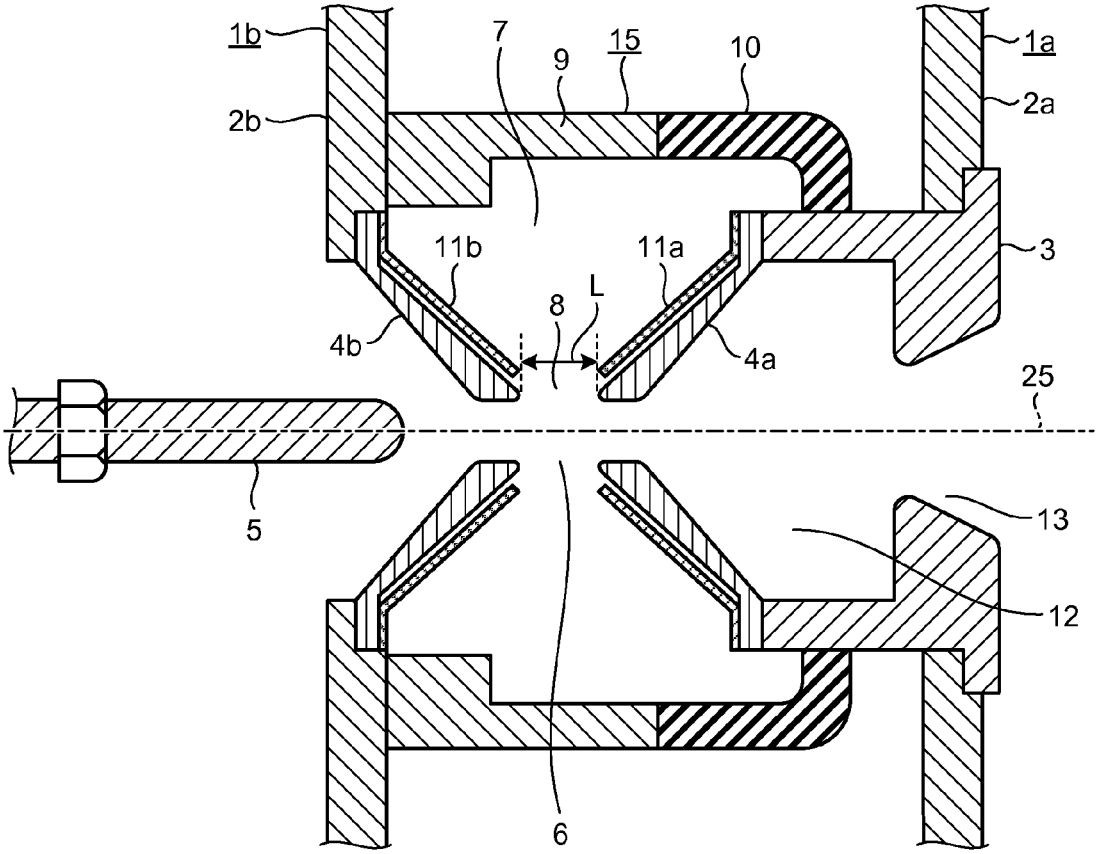
FIG. 2 is a cross-sectional view of a configuration of relevant parts of the arc-quenching chamber of the gas circuit breaker according to the first embodiment, and depicts a current breaking state.

FIG. 1 is a cross-sectional view of a configuration of relevant parts of an arc-quenching chamber of a gas circuit breaker according to the first embodiment, and depicts a power-on state. FIG. 2 is a cross-sectional view of a configuration of relevant parts of the arc-quenching chamber of the gas circuit breaker according to the present embodiment, and depicts a current breaking state.

As shown in FIGS. 1 and 2, a breaking unit of the gas circuit breaker is configured to include a fixed-side energizing member 1*a*, a movable-side energizing member 1*b*, fixed contacts 4*a* and 4*b*, a movable contact 5, guides 11*a* and 11*b*, and an outer peripheral wall 15. This breaking unit is configured to be rotationally symmetrical about a center axis 25, for example. The center axis 25 coincides with the axis of the movable contact 5 having a shaft shape, for example.

The fixed-side energizing member 1*a* is arranged to be opposed to the movable-side energizing member 1*b* in the direction of the center axis 25. In the examples shown in FIGS. 1 and 2, the fixed-side energizing member 1*a* is arranged on the right side, and the movable-side energizing member 1*b* is arranged on the left side.

The fixed-side energizing member 1*a* is configured by, for example, an annular conductor 2*a* and an annular supporting conductor 3 that is arranged inside of the conductor 2*a* and connected to an opening end of the conductor 2*a*. The supporting conductor 3 is energized and connected to the conductor 2*a* to be capable of releasing the connection to the right side (the opposite side to the movable side). The fixed contact 4*a* (first fixed contact) is energized and connected to a movable-side end of the supporting conductor 3. The fixed contact 4*a* is configured to include a plurality of elastic contact fingers. These contact fingers are arranged in a circumferential direction about the center axis 25, separated from each other by slits (not shown), and extend obliquely from the connection point with the supporting conductor 3 toward the center axis 25 and toward the movable side.

The movable-side energizing member 1*b* is configured by an annular conductor 2*b*, for example. The fixed contact 4*b* (second fixed contact) is energized and connected to an opening end of the conductor 2*b*. Similarly to the fixed contact 4*a*, the fixed contact 4*b* is configured to include plural elastic contact fingers. These contact fingers are arranged in the circumferential direction about the center axis 25, separated from each other by slits (not shown), and extend obliquely from the connection point with the conductor 2*b* toward the center axis 25 and toward the fixed side. The fixed contact 4*a* and the fixed contact 4*b* are arranged to be opposed to each other in the direction of the center axis 25.

At the power-on position (FIG. 1), the fixed contacts 4*a* and 4*b* are bridged by the movable contact 5, and the contact fingers of the fixed contacts 4*a* and 4*b* come into contact with an outer periphery of the movable contact 5. The movable contact 5 is driven back and forth in the direction of the center axis 25 by a drive device (not shown). That is, the center axis 25 coincides with an opening-and-closing axis. The movable contact 5 is configured by screw-fastening a distal-end portion that is formed with a screw hole to a base portion that is threaded on its outer periphery. This distal-end portion is formed with a hexagon-shaped portion having a hexagonal cross-sectional shape in order to facilitate its attachment and detachment using a tool.

At the current breaking position (FIG. 2), the movable contact 5 moves to the left, and is in a non-contact state with the fixed contacts 4*a* and 4*b*. In this case, the movable contact 5 is positioned on the further left side than the fixed contact 4*b*, thereby forming an arc chamber 6 between the fixed contacts 4*a* and 4*b*.

Furthermore, in the middle of the current breaking operation, when the movable contact 5 is positioned between the fixed contacts 4*a* and 4*b*, the arc chamber 6 is formed between the fixed contact 4*a* and the movable contact 5. In the arc chamber 6, arc is generated between the movable contact 5 and the fixed contacts 4*a* and 4*b* at the time of switching on and off a current.

The arc chamber 6 is surrounded by an annular heating chamber 7. The heating chamber 7 communicates with the arc chamber 6 through an opening 8 that separates the fixed contacts 4*a* and 4*b* from each other in the circumferential direction. The opening 8 communicates the arc chamber 6 and the heating chamber 7 with each other on a circumferential plane about the center axis 25. The heating chamber 7 is surrounded by the outer peripheral wall 15 having a cylindrical shape. That is, the outer peripheral wall 15 surrounds the heating chamber 7 in the circumferential direction about the center axis 25. The outer peripheral wall 15 is configured by a heat-resistive cylindrical heat-flow receiving wall portion 9 (first wall portion), and a cylindrical wall portion 10 (second wall portion) that is connected to the heat-flow receiving wall portion 9 and is made of an insulating material.

The heat-flow receiving wall portion 9 is arranged at a position opposed to the opening 8 in a radial direction. The radial direction refers to a direction orthogonal to the direction of the center axis 25. The heat-flow receiving wall portion 9 is provided to protect the outer peripheral wall 15 from damage due to hot gas generated with the occurrence of arc, and therefore is arranged at a position opposed to the opening 8, which is the location where hot gas, having flown out of the arc chamber 6 in the radial direction, collides directly. In FIGS. 1 and 2, the length of the opening 8 in the direction of the center axis 25 is represented as L. It is preferable that the heat-flow receiving wall portion 9 has at least a length equal to or larger than L in the direction of the center axis 25, and is arranged so as to cover the opening 8 in the direction of the center axis 25. Because the opening 8 is provided in the circumferential direction, the heat-flow receiving wall portion 9 is arranged so as to cover the opening 8 in the circumferential direction. The heat-flow receiving wall portion 9 is required to have at least a heat resistance higher than that of the wall portion 10.

In the examples shown in FIGS. 1 and 2, the heat-flow receiving wall portion 9 does not have a constant thickness in the radial direction, and the thickness on the side of the conductor 2*b* is greater than the thickness on the side of the wall portion 10. In order to form a flow path extending from a machine puffer chamber (not shown), the heat-flow receiving wall portion 9 has a greater thickness on the side of the conductor 2*b*. However, it is also possible to configure the heat-flow receiving wall portion 9 to have a uniform thickness in the radial direction along the direction of the center axis 25.

The heat-flow receiving wall portion 9 can be formed of a heat-resistive conductive material, for example. In this case, examples of the conductive material include a metal material such as aluminum. It is also possible to use a high-melting-point material such as ceramics.

The heat-flow receiving wall portion 9 is arranged on the movable side for example, and is electrically connected at its one end to the conductor 2*b*. Therefore, the heat-flow receiving wall portion 9 is electrically connected to the movable-side energizing member 1*b* and the fixed contact 4*b*.

The wall portion 10 is arranged on the fixed side (the opposite side to the movable side) for example, and is connected at its one end to the supporting conductor 3. The other end of the wall portion 10 is connected to the heat-flow receiving wall portion 9. Both the center axis of the heat-flow receiving wall portion 9 and the center axis of the wall portion 10 coincide with the center axis 25. The heat-flow receiving wall portion 9 and the wall portion 10 are connected in the direction of the center axis 25 to constitute the outer peripheral wall 15. The heat-flow receiving wall portion 9 and the wall portion 10 are connected with a bolt or the like. As described above, the fixed-side energizing member la and the movable-side energizing member 1*b* are physically connected by the outer peripheral wall 15. However, the outer peripheral wall 15 includes the wall portion 10 that is provided along the circumferential direction and is made of an insulating material, and therefore the outer peripheral wall 15 electrically insulates the fixed-side energizing member 1*a* and the movable-side energizing member 1*b* from each other. In the examples shown in FIGS. 1 and 2, the heat-flow receiving wall portion 9 having conductive properties is provided on the movable side, and the wall portion 10 having insulating properties is provided on the fixed side. However, it is also possible to interchange the positions of the heat-flow receiving wall portion 9 and the wall portion 10. In this case, similarly to the above case, the heat-flow receiving wall portion 9 is arranged at a position opposed to the opening 8 and is electrically connected to the supporting conductor 3.

As described above, in the present embodiment, the wall portion 10 made of an insulating material is provided to be connected to the heat-flow receiving wall portion 9, and the outer peripheral wall 15 constituted by the heat-flow receiving wall portion 9 and the wall portion 10 closes off the outer side of the heating chamber 7.

In the fixed contact 4*a*, on the side of the heating chamber 7, the guide 11*a* is arranged along the fixed contact 4*a*. In the fixed contact 4*b*, on the side of the heating chamber 7, the guide 11*b* is arranged along the fixed contact 4*b*. The space of the heating chamber 7 is defined by the heat-flow receiving wall portion 9, the wall portion 10, and the guides 11*a* and 11*b*.

Furthermore, on the right side (the fixed side) of the arc chamber 6, a pressure chamber 12 is formed by the fixed contact 4*a* and the supporting conductor 3. The pressure chamber 12 is formed with an outlet port 13 constituted by an opening formed on the supporting conductor 3.

The current breaking operation is performed as follows. First, the breaking operation begins from the power-on position in FIG. 1. In this state, a current flows along the conductor 2*a*, the supporting conductor 3, the fixed contact 4*a*, the movable contact 5, the fixed contact 4*b*, and the conductor 2*b*. Next, the movable contact 5 is moved leftward by a drive device (not shown). Therefore, the movable contact 5 is pulled out of the fixed contacts 4*a* and 4*b* in this order and arc is generated between the movable contact 5 and the fixed contacts 4*a* and 4*b*. High-temperature and high-pressure gas heated by this arc in the arc chamber 6 flows into the heating chamber 7 through the opening 8. Also, the gas in the heating chamber 7 is strongly heated by heat radiated by the arc to generate a high pressure in the heating chamber 7. Furthermore, the high-temperature gas having flown into the heating chamber 7 from the arc chamber 6 flows at a very high speed. This hot gas flow collides with the heat-flow receiving wall portion 9. The corresponding portion of the heat-flow receiving wall portion 9, with which the high-temperature and high-speed hot gas flow has collided, reaches a high temperature. However, the heat-flow receiving wall portion 9 has a heat resistance, and is made of metal, for example, and therefore does not suffer from damage such as dissolution loss.

Hot gas having collided with the heat-flow receiving wall portion 9 changes its flowing direction, and a part of the hot gas flows toward the wall portion 10. In this case, while the temperature and flow speed of the hot gas are reduced, the hot gas flows along the wall portion 10. Therefore, the wall portion 10 is not heated at a specific point, and accordingly does not reach a high temperature. Consequently, the wall portion 10 can be prevented from being damaged by hot gas.

Arc is then quenched when a current passes through next zero point. This arc quenching is carried out by blowing off the arc by a part of the gas, which flows out of the heating chamber 7 via the opening 8 into the pressure chamber 12 and to the side of the movable contact 5.

As explained above, according to the present embodiment, the heat-flow receiving wall portion 9 is provided at a position opposed to the opening 8 in the radial direction. Therefore, it is made possible to protect the outer peripheral wall 15 surrounding the heating chamber 7 from damage and heat deterioration due to the influence of hot gas at the time of current breaking. Particularly, the wall portion 10 made of an insulating material can be protected from damage due to hot gas, thereby making it possible to configure the outer peripheral wall 15 to serve as a container of the heating chamber 7 while maintaining the insulating performance of the outer peripheral wall 15.

Second embodiment

Figure 3:
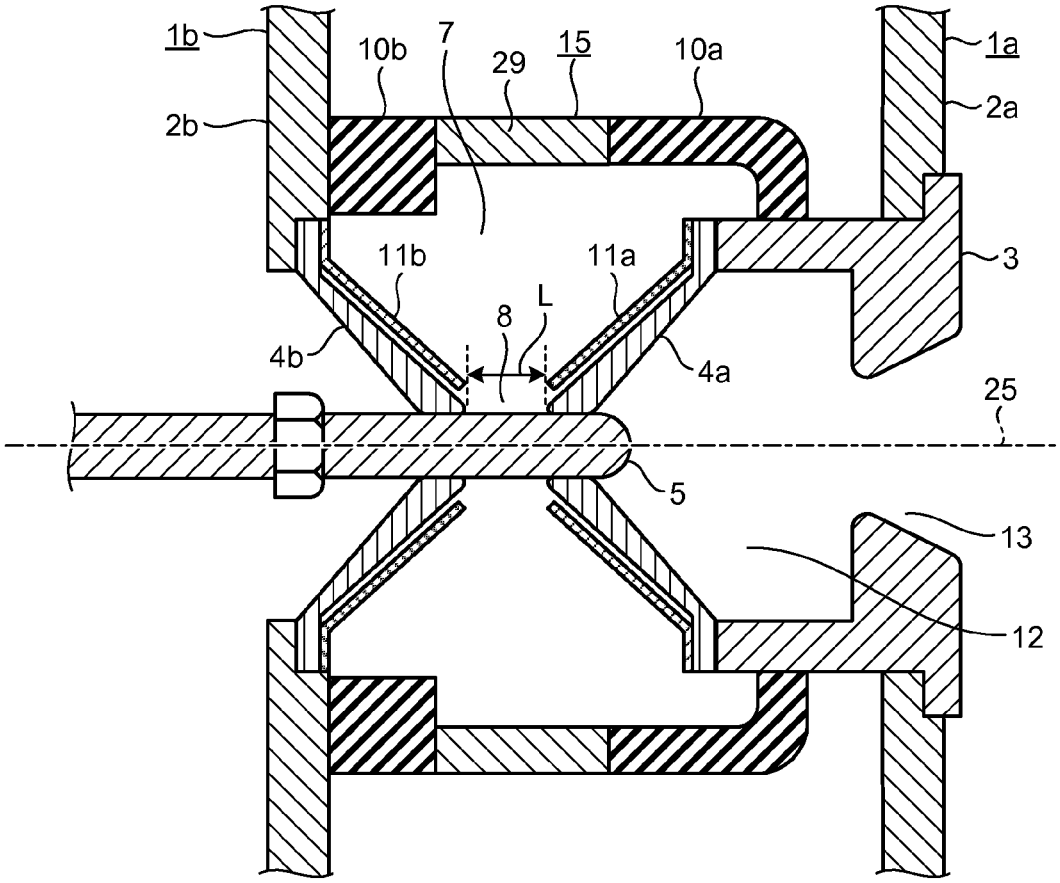
FIG. 3 is a cross-sectional view of a configuration of relevant parts of an arc-quenching chamber of a gas circuit breaker according to a second embodiment, and depicts a power-on state.
Figure 4:
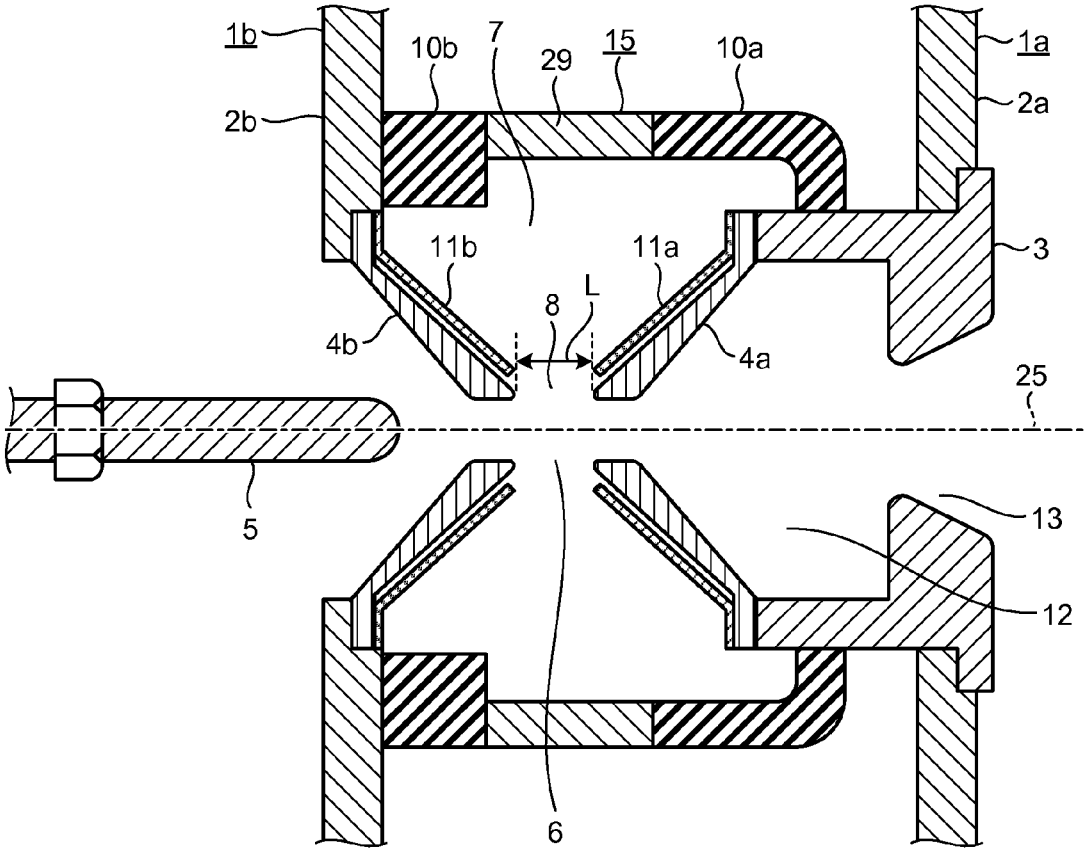
FIG. 4 is a cross-sectional view of a configuration of relevant parts of the arc-quenching chamber of the gas circuit breaker according to the second embodiment, and depicts a current breaking state.

FIG. 3 is a cross-sectional view of a configuration of relevant parts of an arc-quenching chamber of a gas circuit breaker according to the second embodiment, and depicts a power-on state. FIG. 4 is a cross-sectional view of a configuration of relevant parts of the arc-quenching chamber of the gas circuit breaker according to the present embodiment, and depicts a current breaking state. In FIGS. 3 and 4, constituent elements identical to those of FIGS. 1 and 2 are denoted by the same reference signs.

As shown in FIGS. 3 and 4, in the present embodiment, the outer peripheral wall 15 has a configuration different from that in the first embodiment. That is, the outer peripheral wall 15 is configured by a heat-resistive cylindrical heat-flow receiving wall portion 29 (first wall portion), a cylindrical wall portion 10*a* (second wall portion) that is connected to the heat-flow receiving wall portion 29 and is made of an insulating material, and a cylindrical wall portion 10*b* (third wall portion) that is connected to the heat-flow receiving wall portion 29 on the opposite side to where the wall portion 10*a* is connected and is made of an insulating material.

The heat-flow receiving wall portion 29 is arranged at a position opposed to the opening 8 in the radial direction. Similarly to the first embodiment, it is preferable that the heat-flow receiving wall portion 29 has at least a length equal to or larger than L in the direction of the center axis 25, and is arranged so as to cover the opening 8 in the direction of the center axis 25. Because the opening 8 is provided in the circumferential direction, the heat-flow receiving wall portion 29 is arranged so as to cover the opening 8 in the circumferential direction. The heat-flow receiving wall portion 29 is required to have at least a heat resistance higher than those of the wall portions 10*a* and 10*b*.

The heat-flow receiving wall portion 29 is arranged between the wall portions 10*a* and 10*b*, and is connected to the wall portions 10*a* and 10*b* in the direction of the center axis 25. Both the center axis of the heat-flow receiving wall portion 29 and the center axis of the wall portions 10*a* and 10*b* coincide with the center axis 25. One fixed-side end of the heat-flow receiving wall portion 29 is connected to one end of the wall portion 10*a*. One movable-side end of the heat-flow receiving wall portion 29 is connected to one end of the wall portion 10*b*. Furthermore, the other end of the wall portion 10*a* is connected to the supporting conductor 3, and the other end of the wall portion 10*b* is connected to the conductor 2*b*. The heat-flow receiving wall portion 29 and the wall portions 10*a* and 10*b* are connected with a bolt or the like. As described above, the fixed-side energizing member 1*a* and the movable-side energizing member 1*b* are physically connected to each other by the outer peripheral wall 15. However, the outer peripheral wall 15 includes the wall portions 10*a* and 10*b* that are provided along the circumferential direction and made of an insulating material, and therefore the outer peripheral wall 15 electrically insulates the fixed-side energizing member 1*a* and the movable-side energizing member 1*b* from each other.

Other configurations of the present embodiment are identical to those of the first embodiment. For example, as explained in the first embodiment, the heat-flow receiving wall portion 29 can be formed of a heat-resistive conductive material. In this case, examples of the conductive material include a metal material such as aluminum. It is also possible to use a high-melting-point material such as ceramics.

As described above, in the present embodiment, the heat-flow receiving wall portion 29 is connected between the wall portions 10*a* and 10*b* made of an insulating material to constitute the outer peripheral wall 15, and the heat-flow receiving wall portion 29 is arranged at a position opposed to the opening 8. With this arrangement configuration, the present embodiment can exhibit functions and effects that are identical to those of the first embodiment.

In FIGS. 3 and 4, the heat-flow receiving wall portion 29 having conductive properties is interposed between the wall portions 10*a* and 10*b* having insulating properties, and therefore is in an electrically floating state. Accordingly, in addition to the configuration in FIGS. 3 and 4, the heat-flow receiving wall portion 29 can also be connected to the fixed-side energizing member 1*a* or the movable-side energizing member 1*b* by an energizing member such as a conductive wire, in order that the heat-flow receiving wall portion 29 is electrically connected to either one of them. This configuration is useful as it is able to prevent a possible occurrence of electric discharge from the heat-flow receiving wall portion 29.

Third embodiment

Figure 5:
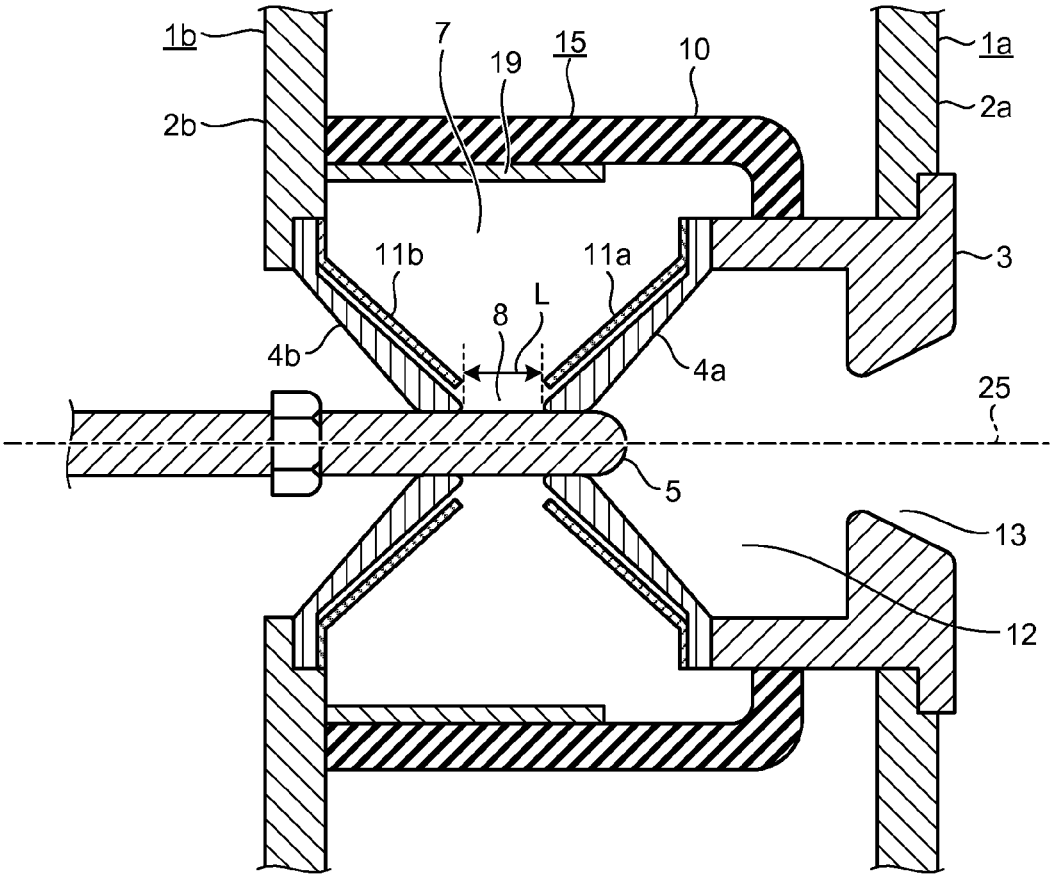
FIG. 5 is a cross-sectional view of a configuration of relevant parts of an arc-quenching chamber of a gas circuit breaker according to a third embodiment, and depicts a power-on state.
Figure 6:
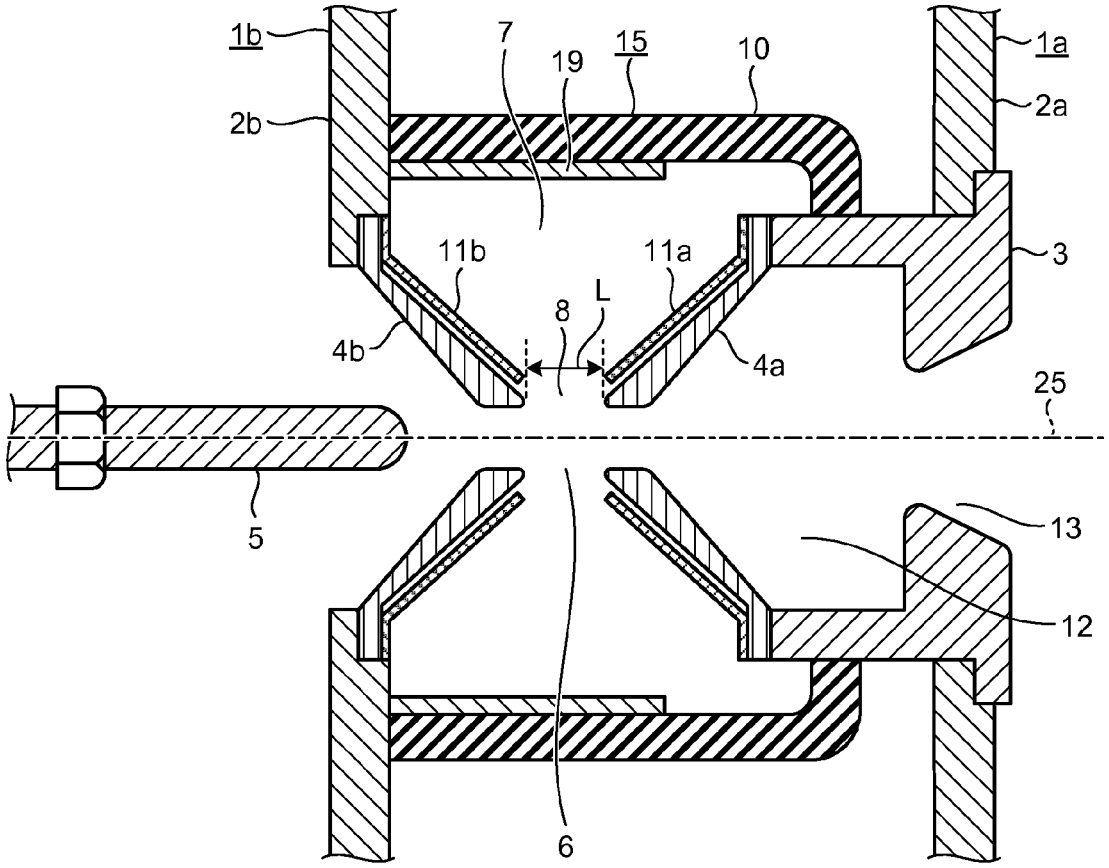
FIG. 6 is a cross-sectional view of a configuration of relevant parts of the arc-quenching chamber of the gas circuit breaker according to the third embodiment, and depicts a current breaking state.

FIG. 5 is a cross-sectional view of a configuration of relevant parts of an arc-quenching chamber of a gas circuit breaker according to the third embodiment, and depicts a power-on state. FIG. 6 is a cross-sectional view of a configuration of relevant parts of the arc-quenching chamber of the gas circuit breaker according to the present embodiment, and depicts a current breaking state. In FIGS. 5 and 6, constituent elements identical to those of FIGS. 1 and 2 are denoted by the same reference signs.

As shown in FIGS. 5 and 6, in the present embodiment, the outer peripheral wall 15 has a configuration different from those in the first and second embodiments. That is, the outer peripheral wall 15 is configured by the cylindrical wall portion 10 that is connected to both the fixed-side energizing member 1*a* and the movable-side energizing member 1*b* and is made of an insulating material and by a heat-resistive cylindrical heat-flow receiving wall portion 19 that is connected to a part of the surface of the wall portion 10 on the side of the heating chamber 7.

The heat-flow receiving wall portion 19 (first wall portion) is arranged at a position opposed to the opening 8 in the radial direction. Similarly to the first and second embodiments, it is preferable that the heat-flow receiving wall portion 19 has at least a length equal to or larger than L in the direction of the center axis 25, and is arranged so as to cover the opening 8 in the same direction. The heat-flow receiving wall portion 19 is arranged so as to cover the opening 8 in the circumferential direction. The heat-flow receiving wall portion 19 is required to have at least a heat resistance higher than that of the wall portion 10.

The heat-flow receiving wall portion 19 is arranged inside of the wall portion 10 coaxially with the wall portion 10. Both the center axis of the heat-flow receiving wall portion 19 and the center axis of the wall portion 10 coincide with the center axis 25. One movable-side end of the heat-flow receiving wall potion 19 is connected to the conductor 2*b*. The wall portion 10 surrounds the heating chamber 7 while insulating the fixed-side energizing member 1*a* and the movable-side energizing member 1*b* from each other. In contrast, the heat-flow receiving wall portion 19 is connected at its one end to the movable-side energizing member 1*b* for example, but is not connected to the fixed-side energizing member 1*a* at the other end. That is, the heat-flow receiving wall portion 19 is connected to either one of the movable-side energizing member 1*b* and the fixed-side energizing member 1*a*.

Other configurations of the present embodiment are identical to those of the first embodiment. For example, as explained in the first embodiment, the heat-flow receiving wall portion 19 can be formed of a heat-resistive conductive material. In this case, examples of the conductive material include a metal material such as aluminum. It is also possible to use a high-melting-point material such as ceramics.

As described above, in the present embodiment, the entirety of the outer peripheral wall 15 surrounding the heating chamber 7 is configured by the wall portion 10 that is made of an insulating material, and also the heat-flow receiving wall portion 19 is arranged on a part of the surface of the wall portion 10 on the side of the heating chamber 7 to be opposed to the opening 8 in the radial direction. With this arrangement configuration, the present embodiment can exhibit functions and effects that are identical to those of the first embodiment.

As described above, in the first to third embodiments, the outer peripheral wall 15 is configured to include a heat-resistive cylindrical first wall portion that is arranged at a position opposed to the opening 8 in a radial direction, and a cylindrical second wall portion that is connected to the first wall portion and also connected to at least one of the fixed-side energizing member 1*a* and the movable-side energizing member 1*b*, and is made of an insulating material. With this configuration, it is possible to provide a gas circuit breaker that is capable of protecting the outer peripheral wall 15 surrounding the heating chamber 7 from damage and heat deterioration due to the influence of hot gas.

Industrial applicability

The present invention is useful as a gas circuit breaker.

REFERENCE SIGNS LIST

1*a* fixed-side energizing member
1*b* movable-side energizing member
2*a*, 2*b* conductor
3 supporting conductor
4*a*, 4*b* fixed contact
5 movable contact
7 heating chamber
8 opening
9, 19, 29 heat-flow receiving wall portion
10, 10*a*, 10*b* wall portion
11*a*, 11*b* guide
12 pressure chamber
13 outlet port
25 center axis

The invention claimed is:

1. A gas circuit breaker comprising:

a fixed-side energizing member;

a movable-side energizing member that is arranged to be opposed to the fixed-side energizing member in an opening-and-closing axis direction;

a first fixed contact that is connected to the fixed-side energizing member;

a second fixed contact that is connected to the movable-side energizing member, and is arranged to be opposed to the first fixed contact in the opening-and-closing axis direction;

a movable contact that is capable of switching between a power-on position and a current breaking position by being driven back and forth in the opening-and-closing axis direction, bridges between the first fixed contact and the second fixed contact at the power-on position, and is brought into non-contact with the first and second fixed contacts at the current breaking position to form an arc chamber between the first and second fixed contacts; and a cylindrical outer peripheral wall that is connected to the fixed-side energizing member and the movable-side energizing member, and that surrounds a heating chamber that communicates with the arc chamber through an opening that separates the first and second fixed contacts from each other in a circumferential direction, wherein the outer peripheral wall includes a heat-resistive cylindrical first wall portion that is formed of a conductive material and arranged at a position opposed to the opening in a radial direction, and a cylindrical second wall portion that is connected to the first wall portion and also connected to at least one of the fixed-side energizing member and the movable-side energizing member, and is made of an insulating material.

2. The gas circuit breaker according to claim 1, wherein the first wall portion covers the opening in the opening-and-closing axis direction.

3. The gas circuit breaker according to claim 2, wherein the first wall portion and the second wall portion are connected in the opening-and-closing axis direction, the first wall portion is connected to one of the fixed-side energizing member and the movable-side energizing member, and the second wall portion is connected to the other one of the fixed-side energizing member and the movable-side energizing member.

4. The gas circuit breaker according to claim 2, wherein the first wall portion and the second wall portion are connected in the opening-and-closing axis direction, the outer peripheral wall includes a cylindrical third wall portion that is connected to the first wall portion on an opposite side to where the second wall portion is connected in the opening-and-closing axis direction and is made of an insulating material, the second wall portion is connected to one of the fixed-side energizing member and the movable-side energizing member, and the third wall portion is connected to the other one of the fixed-side energizing member and the movable-side energizing member.

5. The gas circuit breaker according to claim 2, wherein the second wall portion is connected to both the fixed-side energizing member and the movable-side energizing member, and the first wall portion is arranged inside of the second wall portion to be connected to the second wall portion in a radial direction, and is connected to one of the fixed-side energizing member and the movable-side energizing member.

6. The gas circuit breaker according to claim 4, wherein the first wall portion is electrically connected to either one of the fixed-side energizing member and the movable-side energizing member.

7. The gas circuit breaker according to claim 1, wherein the first wall portion is formed of a metal material or a high-melting-point material.

* * * * *